US010619908B2

(12) United States Patent
Lennon

(10) Patent No.: US 10,619,908 B2
(45) Date of Patent: Apr. 14, 2020

(54) REFRIGERATION CABINET

(75) Inventor: Eoin Lennon, Clane (IE)

(73) Assignee: Orrell Limited, Dublin (IE)

( * ) Notice: Subject to any disclaimer, the term of this patent is extended or adjusted under 35 U.S.C. 154(b) by 142 days.

(21) Appl. No.: 13/583,610

(22) PCT Filed: Mar. 10, 2011

(86) PCT No.: PCT/EP2011/053653
§ 371 (c)(1),
(2), (4) Date: Nov. 9, 2012

(87) PCT Pub. No.: WO2011/110648
PCT Pub. Date: Sep. 15, 2011

(65) Prior Publication Data

US 2013/0047658 A1 Feb. 28, 2013

(30) Foreign Application Priority Data

Mar. 10, 2010 (IE) ..... S2010/0143

(51) Int. Cl.
*F25D 17/06* (2006.01)
*F25B 1/00* (2006.01)
(Continued)

(52) U.S. Cl.
CPC ..... *F25D 17/062* (2013.01); *A47F 3/0413* (2013.01); *F25D 21/04* (2013.01);
(Continued)

(58) Field of Classification Search
CPC ..... F24F 1/007; F25D 2400/10; F25D 2317/06555; F25D 2317/0661;
(Continued)

(56) References Cited

U.S. PATENT DOCUMENTS 1,409,179 A * 3/1922 Huening ..... A47F 3/0421 62/255
1,812,102 A 6/1931 Lundgaard
(Continued)

FOREIGN PATENT DOCUMENTS

CN 2828684 Y 10/2006
CN 1868378 A 11/2006
(Continued)

OTHER PUBLICATIONS

Annex to the Communication from the Examining Division issued by the European Patent Office dated Mar. 12, 2019 in Patent Application No. EP20110713714 entitled A Refrigeration Cabinet filed by Orrell Limited. (5 pages).

*Primary Examiner* — Len Tran
*Assistant Examiner* — Kirstin U Oswald
(74) *Attorney, Agent, or Firm* — Michael Crilly, Esquire

(57) ABSTRACT

A refrigeration cabinet has an insulated body comprising a rectangular base with an upstanding front wall, rear wall and end walls interconnecting the front wall and rear wall. The body forms an open-topped product chamber. A clear glass or clear plastics lid is mounted by hinges at a top of the rear wall to close the product chamber whilst at the same time allow customers to view chilled or frozen merchandise on display within the product chamber. At one end of the body a refrigeration unit is provided for generating a climate control cold air stream for circulation through the product chamber in order to maintain the merchandise in the product chamber in a chilled or frozen condition as required. An air distribution insert is demountably secured in the product chamber and cooperates with an inner liner of the insulated body to form air circulation ducts for delivery of the cold air stream generated by the refrigeration unit to and from the product chamber to circulate the climate control cold air
(Continued)

stream through the product chamber in a controlled manner between a bottom and a top of the product chamber.

11 Claims, 12 Drawing Sheets

(51) Int. Cl.

| | |
|---|---|
| ***F25D 23/00*** | (2006.01) |
| ***A47F 3/04*** | (2006.01) |
| ***F25D 23/02*** | (2006.01) |
| ***F25D 21/04*** | (2006.01) |
| *F25D 23/08* | (2006.01) |

(52) U.S. Cl.
CPC ..... *F25D 23/026* (2013.01); *F25D 23/087* (2013.01); *F25D 2317/063* (2013.01); *F25D 2317/0655* (2013.01); *F25D 2317/0661* (2013.01); *F25D 2400/10* (2013.01)

(58) Field of Classification Search
CPC ..... F25D 2317/063; F25D 23/087; F25D 17/062; F25D 2317/062; F25D 21/04; F25D 23/026; F25D 2317/0655; A47F 3/0413; A47F 3/0408; A47F 3/0443
USPC ..... 62/407, 408, 410–412, 419; 220/592.02
See application file for complete search history.

(56) References Cited

U.S. PATENT DOCUMENTS 1,841,277 A * 1/1932 Carter ..... A47F 3/0404 62/246
1,998,681 A * 4/1935 Littleford, Jr. ..... F25D 3/125 62/457.1
2,018,274 A * 10/1935 Madden ..... B61D 27/0018 454/105
2,200,502 A * 5/1940 Johnson ..... F25B 39/02 62/419
2,255,947 A * 9/1941 Starr ..... A47F 3/0404 62/254
2,273,233 A * 2/1942 Tanner ..... F25D 17/06 62/378
2,425,232 A * 8/1947 Guyon ..... F25D 25/024 312/308
2,425,473 A * 8/1947 Hoffman ..... A47F 3/0452 62/254
2,439,261 A 4/1948 Munshower
2,446,686 A * 8/1948 Behrens ..... F25D 11/04 62/255
2,492,695 A * 12/1949 Henderson ..... A47F 3/0452 62/252
2,508,768 A 5/1950 Munshower
2,515,709 A * 7/1950 Heard ..... B65D 81/3834 220/23.87
2,686,405 A * 8/1954 Pichler ..... A47F 3/0443 62/253
2,926,507 A * 3/1960 Ingolia ..... F25D 17/062 62/377
2,978,884 A * 4/1961 D Aleandro ..... F25D 17/08 62/413
3,019,620 A * 2/1962 Costantini ..... F25D 17/06 62/418
3,364,694 A * 1/1968 Cohen ..... F25D 25/021 62/265
3,466,891 A * 9/1969 Maxwell ..... F25D 17/065 62/419
3,473,345 A * 10/1969 Pfeiffer ..... F25D 17/065 62/408
3,667,249 A * 6/1972 Brown ..... F25C 5/185 62/312
3,887,102 A * 6/1975 Earley ..... F25D 25/022 220/8
4,019,339 A * 4/1977 Anderson ..... A47F 3/0443 62/255
4,304,101 A * 12/1981 Gidseg ..... F25D 17/065 62/187
4,368,622 A * 1/1983 Brooks ..... F25D 17/062 62/157
4,544,024 A * 10/1985 Baggott ..... A47J 39/006 165/48.1
4,662,186 A * 5/1987 Park ..... F25D 17/045 62/265
4,826,040 A * 5/1989 Jahr, Jr. ..... B29C 44/18 220/592.11
4,860,555 A * 8/1989 Bishop ..... A23B 7/05 62/376
4,882,910 A * 11/1989 Meehan ..... A47F 3/0443 62/256
5,191,769 A * 3/1993 Mangini ..... A47F 3/0408 165/122
5,417,080 A * 5/1995 Bishop ..... A23B 7/00 312/402
5,442,932 A * 8/1995 O'Hearne ..... A47F 3/0447 62/255
6,094,934 A 8/2000 Rand et al.
6,170,276 B1 1/2001 Mandel et al.
6,182,459 B1 2/2001 Hertel
6,385,990 B1 * 5/2002 Lee ..... A47F 3/0408 62/258
2003/0230104 A1 * 12/2003 Morse ..... F25D 19/00 62/277
2005/0268639 A1 * 12/2005 Hortin ..... B67D 1/0009 62/389
2006/0248916 A1 * 11/2006 Kim ..... F25D 17/065 62/408
2007/0084234 A1 * 4/2007 Park ..... F25D 21/04 62/407
2008/0245089 A1 * 10/2008 Bhatti ..... F25D 7/00 62/259.4
2008/0265733 A1 * 10/2008 Hue ..... F25D 25/025 312/404
2008/0302125 A1 * 12/2008 Cushman ..... F25D 25/025 62/408
2009/0000316 A1 * 1/2009 Cohen ..... F25D 19/00 62/77
2011/0123697 A1 * 5/2011 Patterson ..... B65D 81/22 426/394

FOREIGN PATENT DOCUMENTS

DE 8714644 U1 1/1988
EP 0803213 A2 10/1997
EP 1688688 A1 8/2006

* cited by examiner

REFRIGERATION CABINET

CROSS REFERENCE TO RELATED APPLICATIONS

The present application claims priority to PCT Application No. PCT/EP2011/053653 filed Mar. 10, 2011, which in turn claims priority to Irish Patent Application No. S2010/0143 filed Mar. 10, 2010, said applications being incorporated in their entirety herein by reference thereto.

FEDERALLY SPONSORED RESEARCH AND DEVELOPMENT

None.

BACKGROUND OF THE INVENTION

1. Field of the Invention

This invention relates to refrigeration cabinets. The invention is particularly concerned with commercial refrigeration cabinets of the type used in retail outlets for the storage and display of frozen products for sale.

2. Background

Typically such cabinets comprise a product chamber having an associated refrigeration system with an evaporation coil which is wound about the sidewalls of the product chamber for chilling the product chamber. To promote good heat transfer the inner wall or liner of the cabinet about which the evaporator coils is typically of aluminium material. During operation frost will gradually build up on the inner sidewalls of the cabinet and must be removed. This is generally done by either passing hot refrigerant gases through the evaporator coil, or by means of electric heating elements mounted on the sidewalls. However, a major disadvantage of this system is the fact that the interior of the cabinet is heated during the defrost cycle and this may at least partially defrost the goods within the cabinet which is undesirable. Also, after the defrost cycle has been completed, increased energy is required to bring the temperature within the cabinet back down to the desired storage temperature. Further, to allow for the rise in temperature within the cabinet during each defrost cycle, the refrigeration apparatus in normal operation may be set to cool the cabinet interior to about −24° C. rather than about −20° C. which is the desired storage temperature for the goods stored within the cabinet. Thus, there is considerable energy wastage during the normal running of these cabinets.

The present invention is directed towards overcoming these problems.

SUMMARY OF THE INVENTION

According to the invention there is provided a refrigeration cabinet including: a product chamber; means for generating a climate control cold air stream; and air delivery means for delivering said climate control cold air stream through the product chamber in a controlled manner, the air delivery means having an air inlet communicating with a lower portion of the product chamber and an air outlet communicating with the product chamber above the air inlet.

In one embodiment of the invention the air outlet communicates with an upper portion of the product chamber.

In another embodiment the air delivery means includes an air inlet duct formed in a side wall of the product chamber at the lower portion of the product chamber and an air outlet duct formed in the side wall of the product chamber at an upper portion of the product chamber, the air inlet duct having an air inlet opening communicating with the product chamber and the air outlet duct having an air outlet opening communicating with the product chamber, each air duct being connected to the means for generating a climate control cold airstream for circulating said climate control cold airstream through the product chamber.

In another embodiment the air inlet comprises an air inlet duct extending at least partially about the lower portion of the product chamber and the air outlet comprises an air outlet duct extending at least partially about the upper portion of the product chamber, each air duct having a plurality of openings communicating with the product chamber for through-passage of air between said duct and the product chamber, and each air duct communicating with the means for generating a climate control cold air stream.

In another embodiment the air delivery means includes an air distribution insert mounted in the product chamber, an exterior of the insert cooperating with an inner wall of the product chamber to define the air ducts, the air distribution insert having openings for through passage of air between the ducts and the product chamber.

In another embodiment the air distribution insert is demountably secured in the product chamber.

In another embodiment the cabinet comprises an outer casing, a liner forming the product chamber mounted within the outer casing and spaced-apart therefrom, insulation material mounted between the outer casing and the liner, the air distribution insert being mounted within the liner and cooperating with the liner to form the air inlet duct and the air outlet duct.

In another embodiment a sealing element is mounted between the liner and the insert between air inlet openings at a bottom of the air distribution insert and air outlet openings at a top of the air distribution insert isolating the air inlet openings from the air outlet openings to define the air inlet duct and air outlet duct between the liner and the air distribution insert.

In another embodiment the sealing element is mounted on the liner.

In another embodiment the sealing element is mounted on the air distribution insert.

In another embodiment the liner has a base with upstanding side walls, a number of air deflectors are mounted spaced-apart on the base and project upwardly therefrom, the air distribution insert seating on said air deflectors, said air deflectors for controlling distribution of cooling air to the air inlet duct openings of the air distribution insert communicating with the product chamber.

In another embodiment the means for generating a climate control cold air stream is a refrigeration unit including a refrigerant circulating system having a compressor, a condenser, a throttle, an evaporator and a fan for delivering air across the evaporator for generating the climate control cold air stream. Conveniently as the evaporator is remote from the cabinet no heating of the cabinet interior occurs due to defrosting.

In another embodiment the refrigeration unit is mounted on a cassette which is demountably engagable with the cabinet. Thus, conveniently for maintenance and repair, the cassette can simply be removed and changed without interruption of the cooling of the cabinet.

BRIEF DESCRIPTION OF THE DRAWINGS

The invention will be more clearly understood by the following description of some embodiments thereof, given by way of example only, with reference to the accompanying drawings.

DETAILED DESCRIPTION OF THE INVENTION

Figure 1:
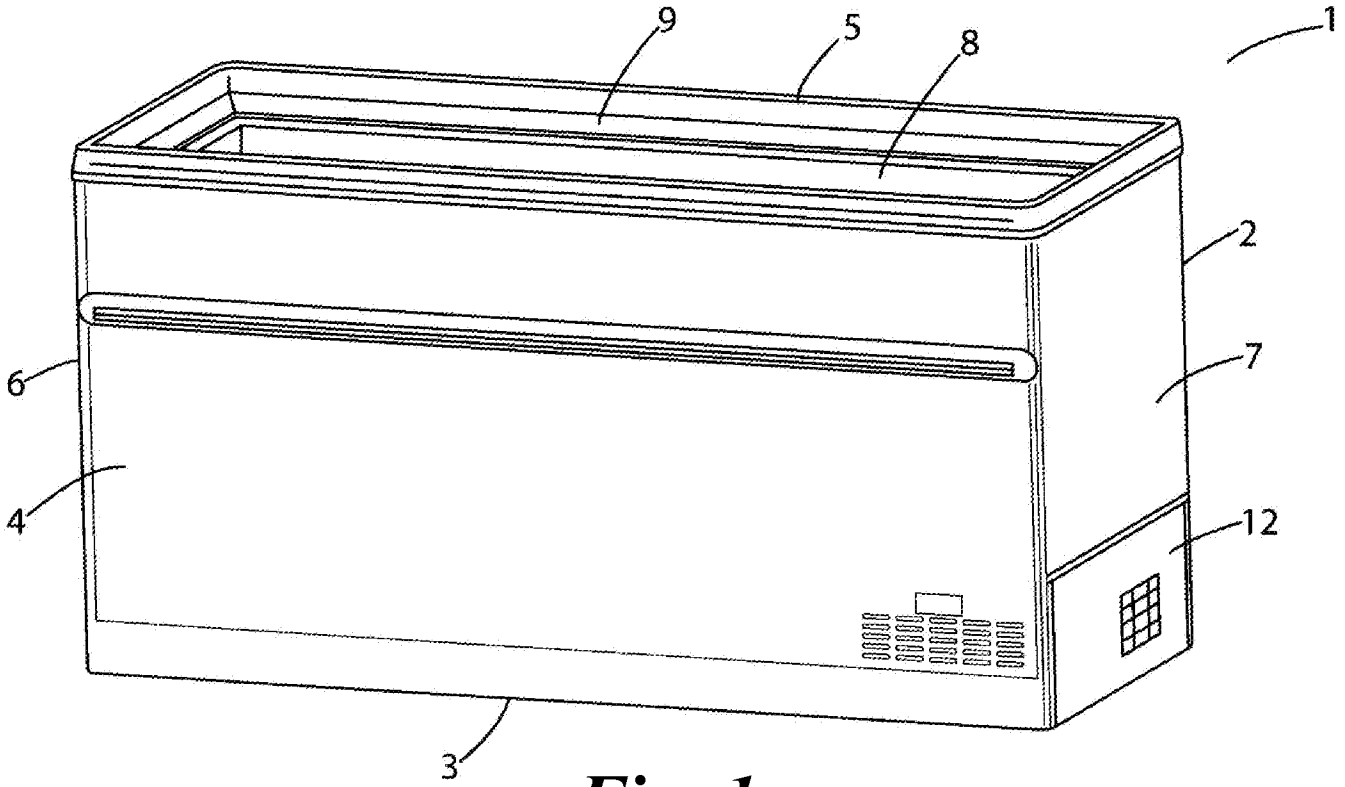
FIG. 1 is a perspective view of a refrigeration cabinet according to the invention.
Figure 2:
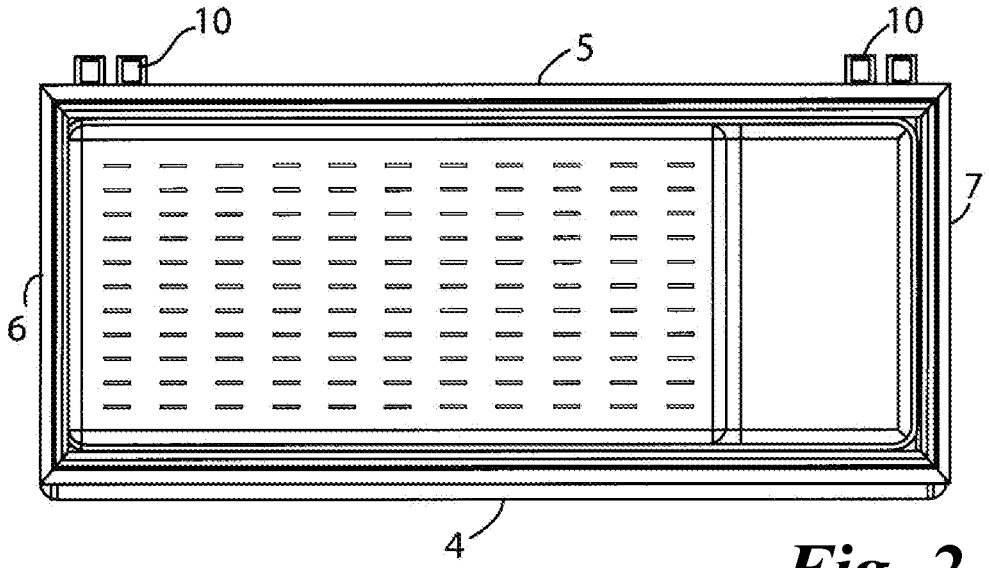
FIG. 2 is a plan view of the refrigeration cabinet.

Referring to the drawings, and initially to FIGS. 1 to 4 thereof, there is illustrated a refrigeration cabinet according to the invention, indicated generally by the reference numeral 1. The refrigeration cabinet 1 has an insulated body 2 comprising a rectangular base 3 with an upstanding front wall 4, rear wall 5 and end walls 6, 7 interconnecting the front wall 4 and rear wall 5. The body 2 forms an open-topped product chamber 8. A clear glass or clear plastics lid 9 is hingedly mounted by hinges 10 at a top of the rear wall 5 to close the product chamber 8 whilst at the same time allow customers to view chilled or frozen merchandise on display within the product chamber 8. At one end of the body 2 a refrigeration unit 12 is provided for generating a climate control cold air stream for circulation through the product chamber 8 in order to maintain the merchandise in the product chamber 8 in a chilled or frozen condition as required. An air distribution insert 15 is demountably secured in the product chamber 8 and cooperates with inner side walls 23 of the product chamber 8 to form an air circulation duct for delivery of the cold air stream generated by the refrigeration unit 12 to and from the product chamber 8 to circulate the climate control cold air stream through the product chamber 8 in a controlled manner.

Figure 3:
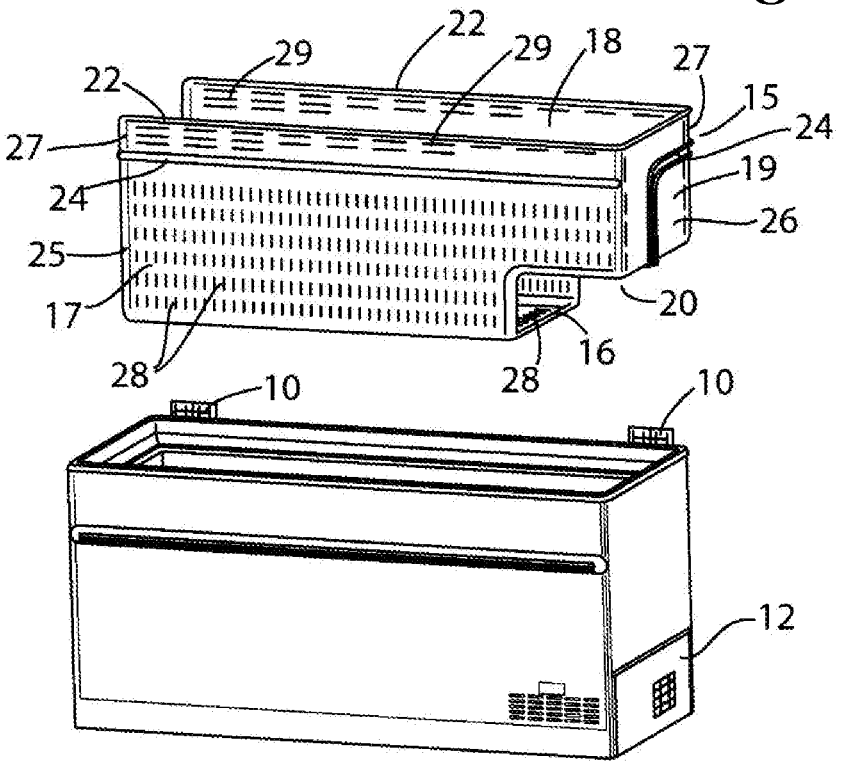
FIG. 3 is an exploded perspective view of the refrigeration cabinet.

Referring now in particular to FIG. 3, the insert 15 has a bottom panel 16 with an upstanding front panel 17, rear panel 18 and an end panel 19 interconnecting the front panel 17 and rear panel 18 at one end. A step 20 is provided in the insert 15 at one end to accommodate a complementary step within the product chamber 8 of the cabinet body 2 which forms a housing for the refrigeration unit 12.

An outwardly projecting rim 22 at a top of the front panel 17, rear panel 18 and end panel 19 engages and forms an airtight seal with the inner wall 23 of the cabinet body 2. Spaced below the rim 22 on the outer faces of each of the front panel 17 and rear panel 18 is a pair of spaced-apart outwardly projecting sealing ribs 24. Each pair of sealing ribs 24 extends parallel to the rim 22 between opposite ends of the insert 15. At an outer face 26 of the end panel 19, the ribs 24 form an L-shaped projection to sealingly engage an inner face of the end wall 7 of the cabinet body 2. The ribs 24 cooperate with an inner side wall 23 of the cabinet body 2 to form air ducts for delivery of conditioning air generated by the refrigeration unit 12 into and out of the product chamber 8. Essentially, the rim 22 and ribs 24 divide the space between the exterior of the insert 15 and the inner side wall 23 of the cabinet body 2 into a lower air inlet duct 25 below the ribs 24 and an upper air outlet duct 27 between the ribs 24 and the rim 22. It will be appreciated that instead of having the ribs 24 on the insert 15, they could be provided on the inner wall 23 of the cabinet body 2.

A number of spaced-apart air inlet openings 28 in the front panel 17 and rear panel 18 below the ribs 24, and also optionally in the bottom panel 16, allow through-passage of air supplied from the refrigeration unit 12 through the air inlet duct 25 into the product chamber 8. Also, a plurality of spaced-apart air outlet openings 29 in the front panel 17 and rear panel 18 between the ribs 24 and the rim 22 allow return of air through the outlet duct 27 to the refrigeration unit 12.

It will be noted in this case that a greater number of air outlet openings 29 are provided at an end of the insert 15 remote from the refrigeration unit 12 than at the end of the insert 15 adjacent the refrigeration unit 12. This helps promote a more even flow of cooling air through the product chamber 8.

Figure 4:
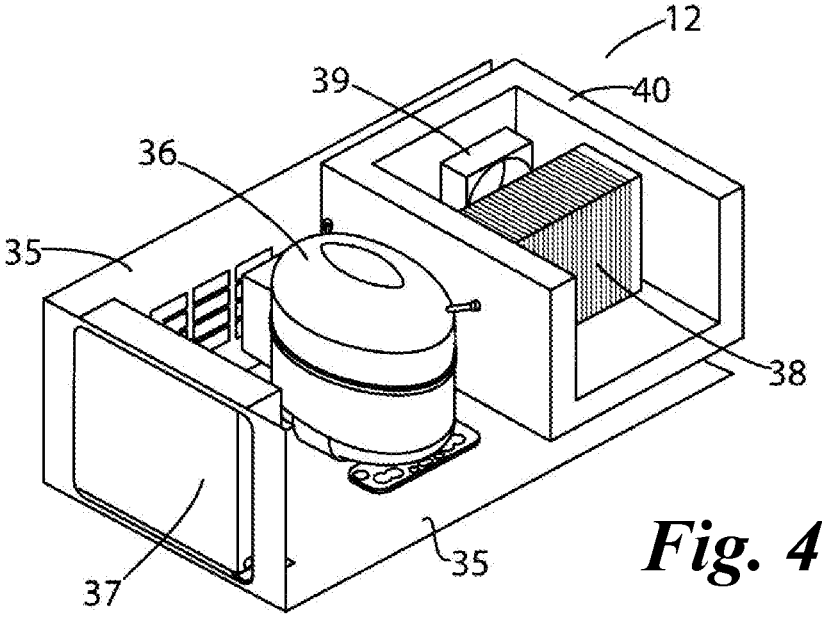
FIG. 4 is an enlarged detail perspective view showing refrigeration apparatus for the cabinet.

The refrigeration unit 12 is shown in more detail in FIG. 4. This comprises a cassette or tray 35 slidably mounted on the cabinet body 2. The refrigeration unit 12 has a compressor 36, a condenser 37, a throttle (not shown), an evaporator 38 and a fan 39 for delivering air across the evaporator 38 and into the cooling air inlet duct 25. The evaporator 38 and associated fan 39 are housed within an insulated casing 40. Conveniently, the tray 35 can be removed from the cabinet body 2 for maintenance or replacement. A power cable (not shown) can be plugged into a mains power supply to drive the refrigeration unit 12.

In use, the insert 15 is mounted within the cabinet body 2. Merchandise for sale is loaded into the product chamber 8. During a cooling cycle the fan 39 delivers air across the evaporator 38 for cooling. The cooled air is then circulated through the air inlet duct 25 and through the inlet openings 28 into the product chamber 8 for maintaining the merchandise in a chilled or frozen state as required. The air stream rises up through the product chamber 8 and exits through the outlet openings 29 at a top of the product chamber 8 for recirculation through the air outlet duct 27 back to an inlet of the fan 39 for further cooling and recirculation through the product chamber 8. It will be noted that as the evaporator is located remote from the product chamber 8, defrosting of the evaporator does not adversely affect the temperature within the product chamber 8 and merchandise therein during the defrost cycle.

Advantageously in accordance with the present invention cold air is delivered into the bottom of the product chamber 8 and is gradually displaced upwardly through the product chamber 8 and drawn out at the top of the product chamber 8. A layer of "warmer" air tends to form immediately below the glass lid 9, above the air outlets, to avoid the condensation and frosting on an underside of the lid which is a common problem with this type of refrigeration cabinet. The cooling air is slowly fed through the product chamber 8 to avoid any air turbulence at the lid. Further, the evaporator is remote from the product chamber 8 and frost will build up on the evaporator—not within the product chamber 8. In addition, the provision of the refrigeration unit in a compact self-contained cassette means it can be easily and quickly removed for maintenance and repair—simply being replaced by another cassette to avoid any interruption to cooling of the product chamber 8 and possible damage to merchandise therein.

Figure 5:
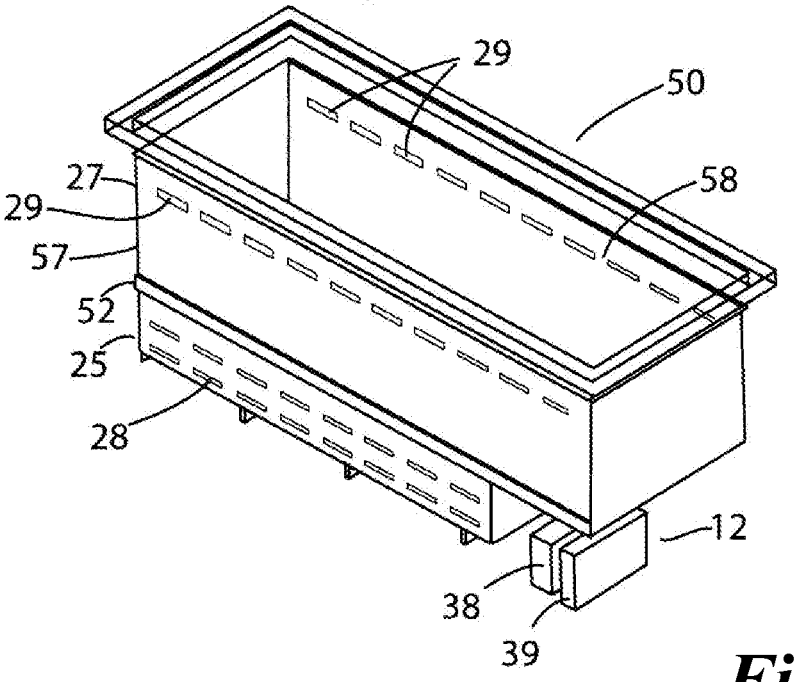
FIG. 5 is a perspective view of portion of another refrigeration cabinet according to a second embodiment of the invention.
Figure 6:
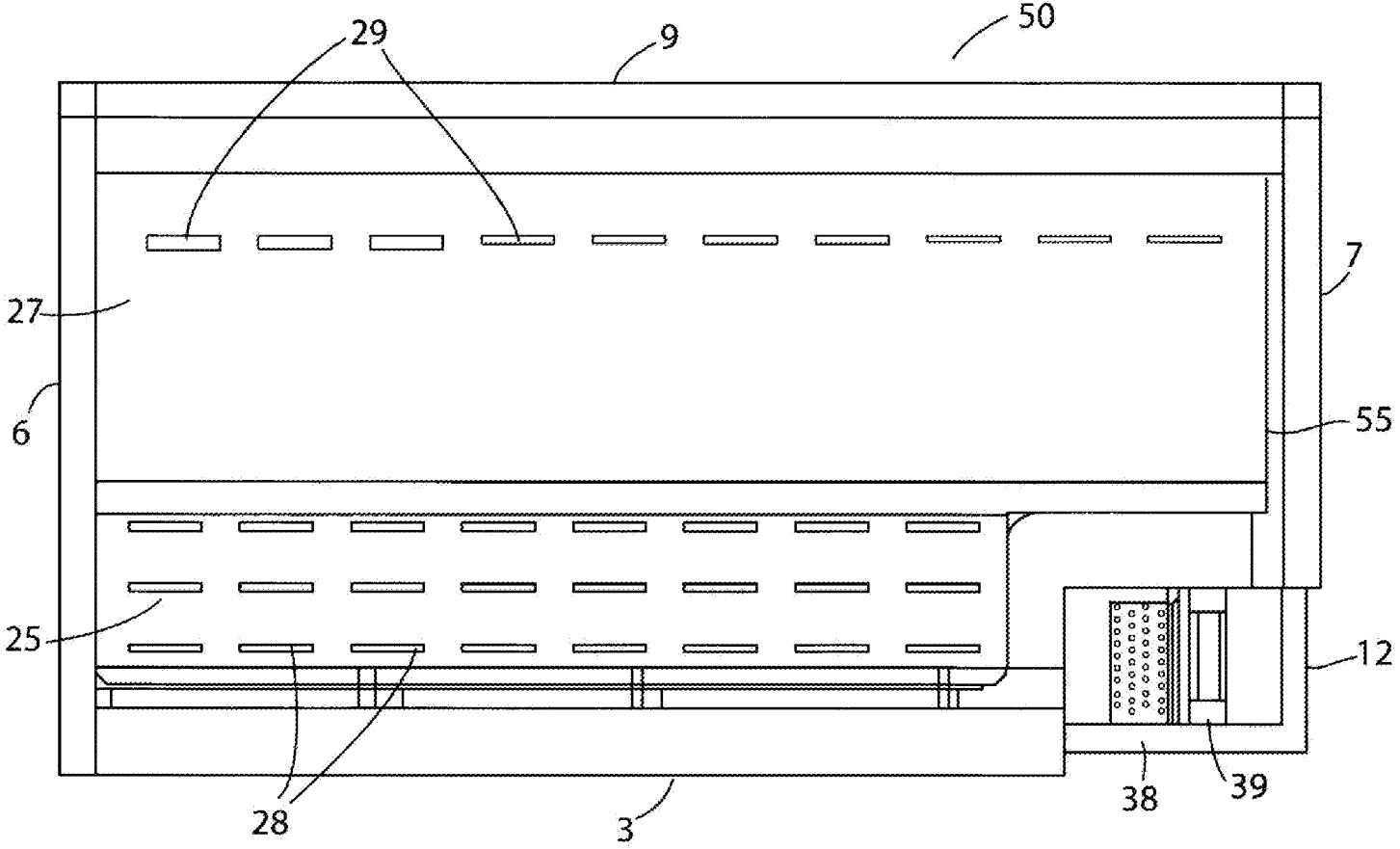
FIG. 6 is a sectional elevational view of the refrigeration cabinet shown in FIG. 5.
Figure 7:
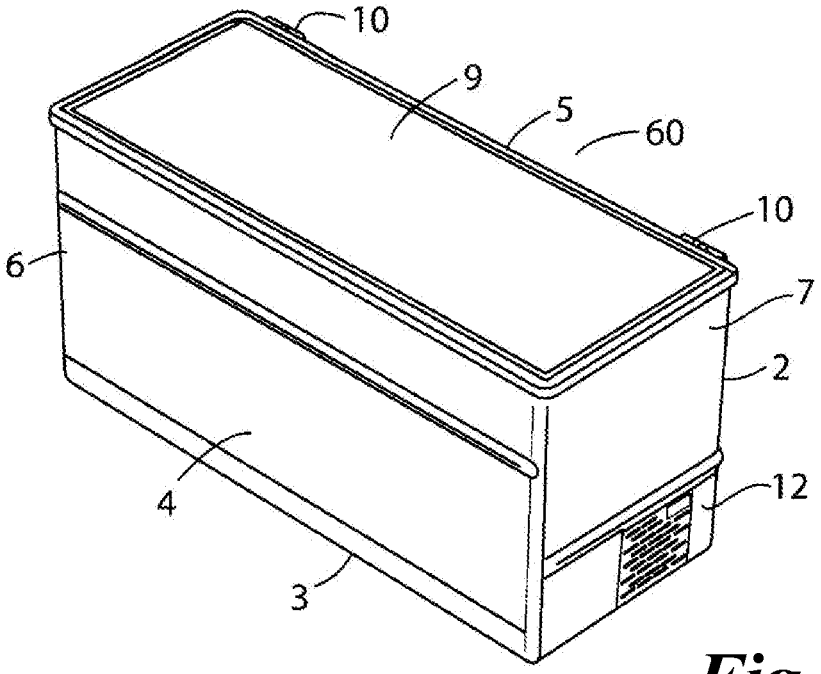
FIG. 7 is a perspective view of another refrigeration cabinet according to a third embodiment of the invention.
Figure 8:
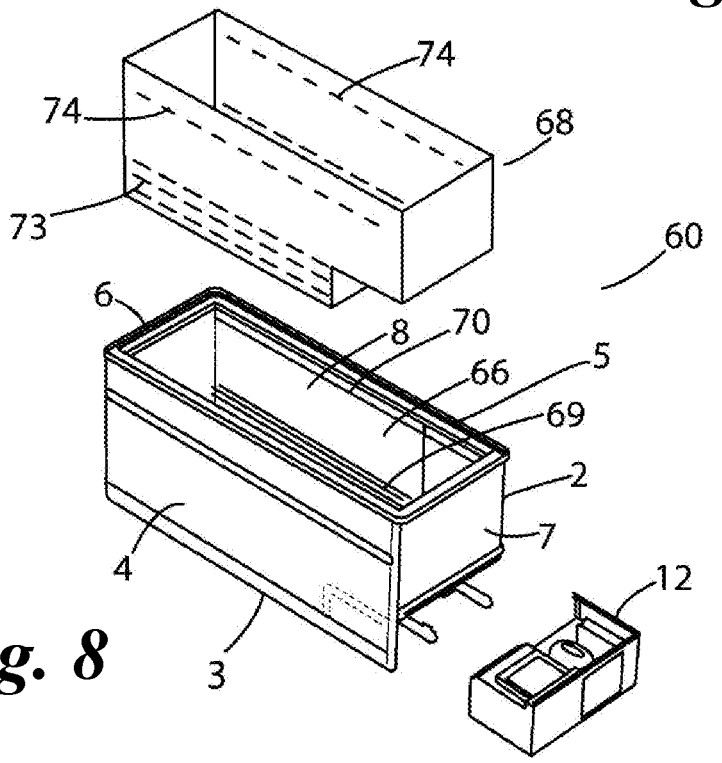
FIG. 8 is an exploded perspective view of the refrigeration cabinet of FIG. 7.

Referring now to FIGS. 5 and 6, there is shown another refrigeration cabinet according to a second embodiment of the invention indicated generally by the reference numeral 50. Parts similar to those described previously are assigned the same reference numerals. In this case an air distribution insert 55 has a sealing element formed by a sealing strip 52 provided on an exterior of a front panel 57 and a rear panel 58 of the insert 55 to form the air inlet duct 25 and the air outlet duct 27. It will be noted also that the air outlet openings 29 increase in size at the end of the insert 55 remote from the refrigeration unit 12. The refrigerated cabinet 50 operates in similar fashion to the refrigerated cabinet 1 described previously.

Referring now to FIGS. 7 to 13, there is shown another refrigeration cabinet according to a third embodiment of the invention indicated generally by the reference numeral 60. This is largely similar to the refrigeration cabinets described previously and like parts are assigned the same reference numerals. An insulated cabinet body 2 has an inner liner 66. The liner 66 has an air inlet 67 which cooperates with an outlet duct from the evaporator 38 for delivery of cooling air to an interior of the liner 66. An inner air distribution insert 68 sits down into the liner 66. Horizontal ribs 69, 70 forming sealing elements extend inwardly from front and rear sidewalls of the liner 66 to engage front and rear outer sidewalls of the insert 68, thus defining the air ducting for feeding the cool air into the bottom of the product chamber 8 and exhausting the warmer air at the top of the product chamber 8. The lower ribs 69 engage the insert 68 just above rows of air inlet openings 73 at a bottom of front and rear side walls of the insert 68. The upper ribs 70 engage the insert 68 above a row of outlet openings 74 adjacent a top of the insert 68.

Figure 10:
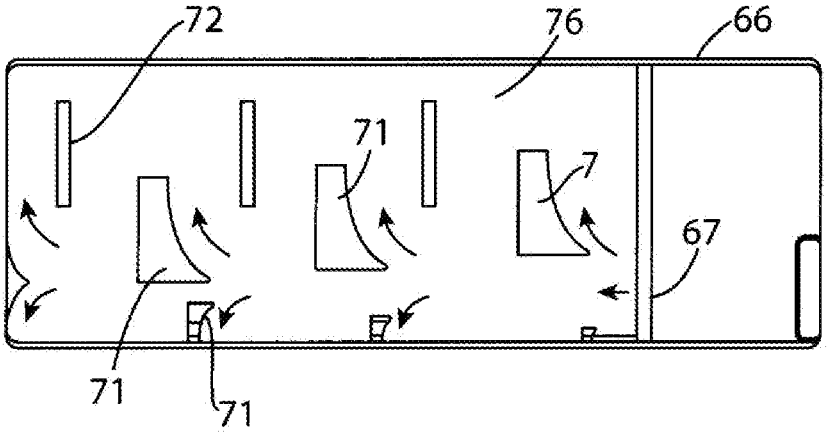
FIG. 10 is a detail plan view of a liner forming an inner wall of the refrigeration cabinet of FIG. 7.
Figure 11:
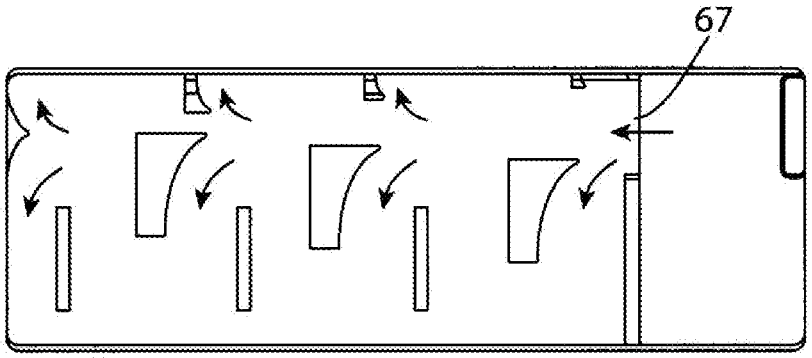
FIG. 11 is a detail underneath plan view of the liner of FIG. 10.

FIG. 10 shows air deflectors 71 which project upwardly from a base 76 of the liner 66. The insert 68 sits on and is supported by these air deflectors 71 and additional support walls 72. The air deflectors 71 distribute cooling air (as indicated by arrows) from the refrigeration unit to the air inlet openings 73 on the insert 68 for an even supply of cooling air to a bottom of the refrigeration cabinet 60 product chamber 8.

Figure 12:
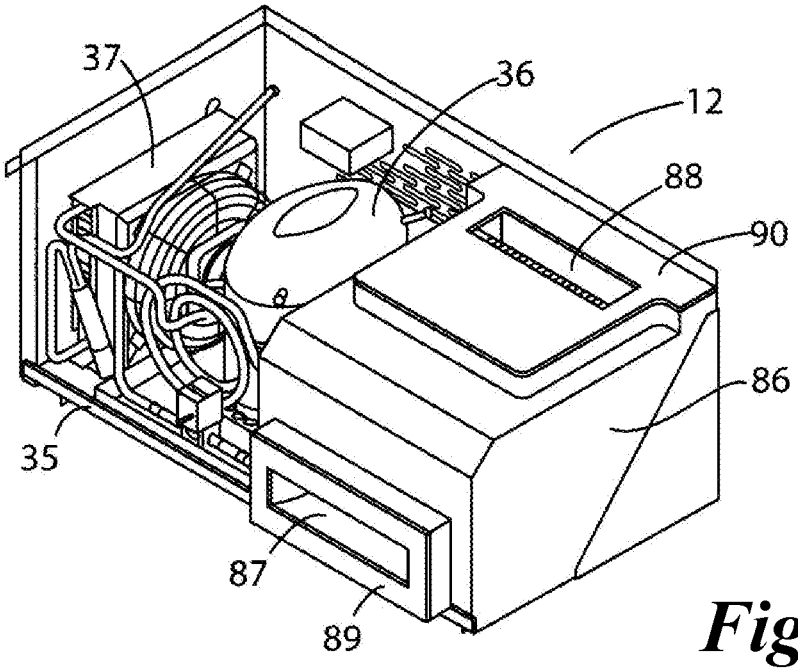
FIG. 12 is a detail perspective view of a refrigeration unit cassette of the refrigeration cabinet of FIG. 7.
Figure 13:
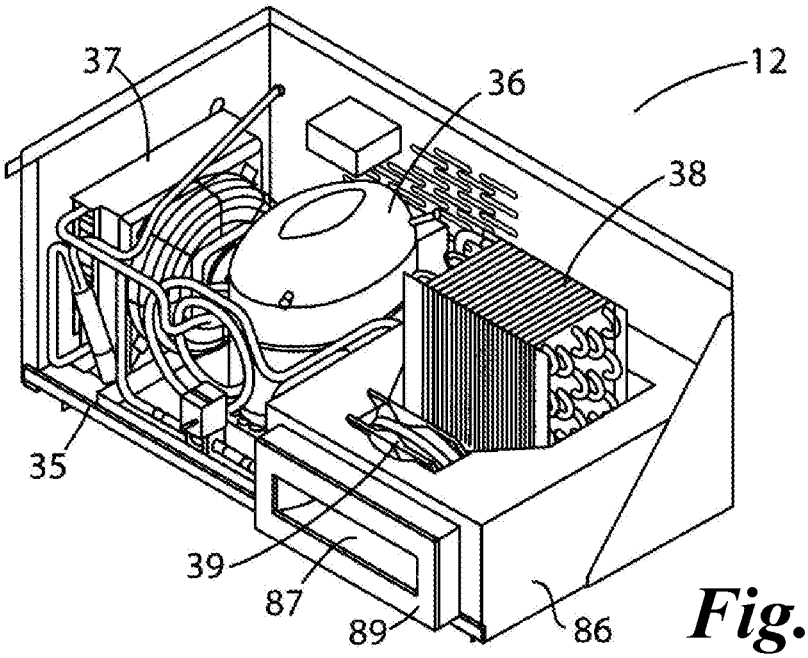
FIG. 13 is a view similar to FIG. 12 with portion of an evaporator casing of the cassette removed.
Figure 15:
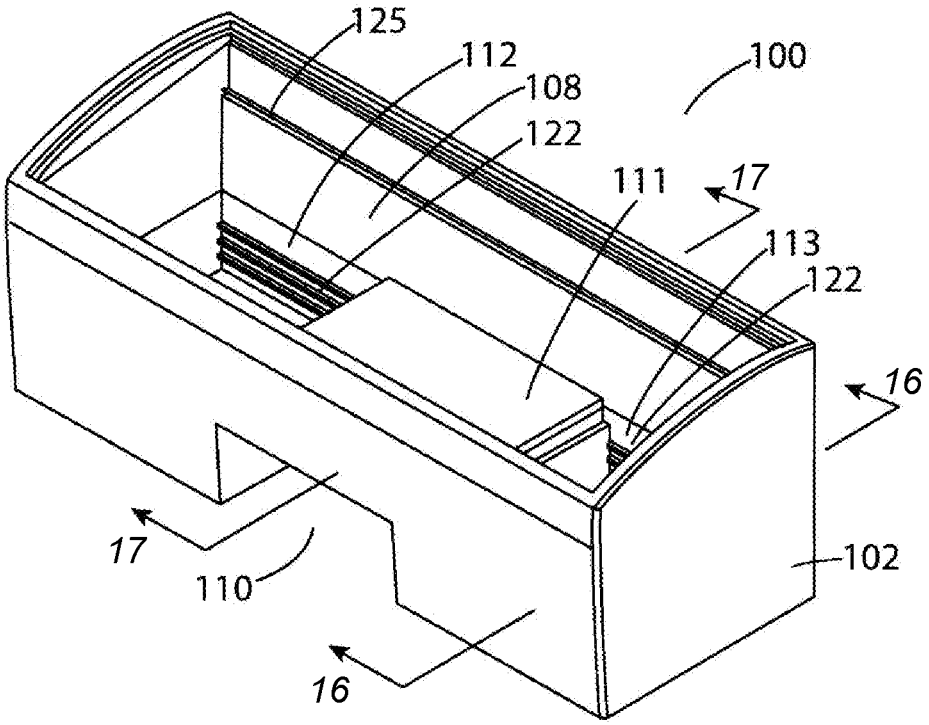
FIG. 15 is a perspective view of another refrigeration cabinet according to a fourth embodiment of the invention.
Figure 16:
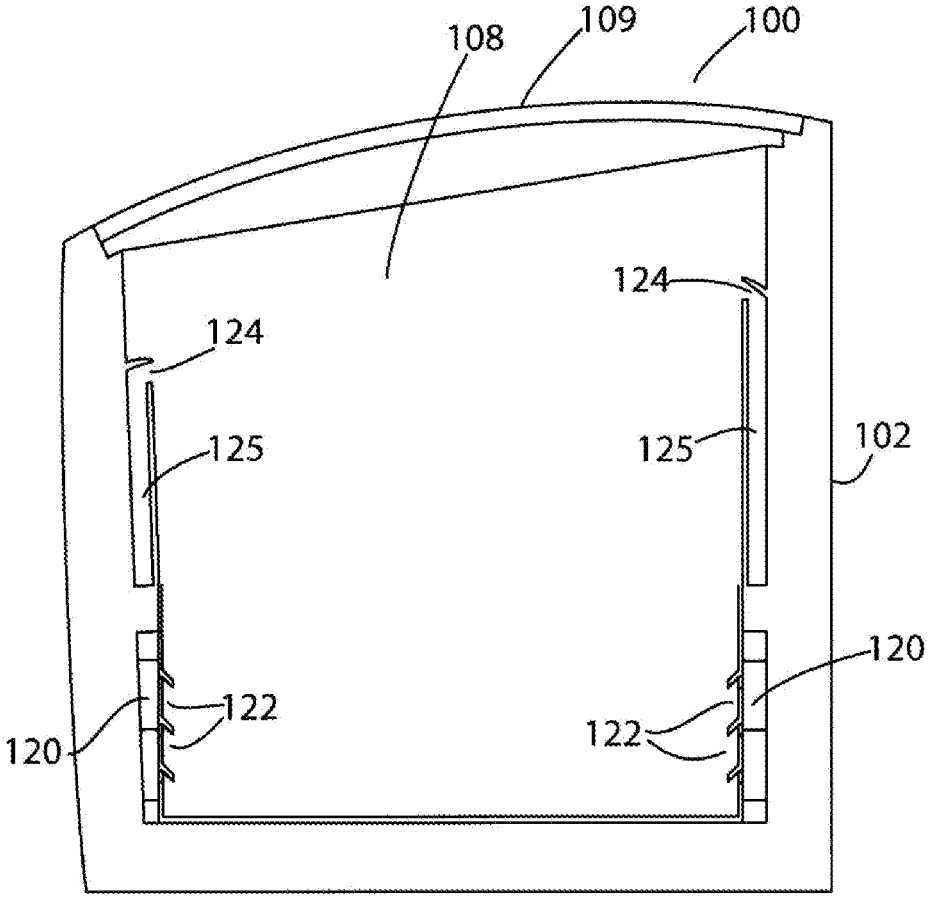
FIG. 16 is a side sectional elevational view of the refrigeration cabinet of FIG. 15 taken along the line XVI-XVI in FIG. 15.
Figure 17:
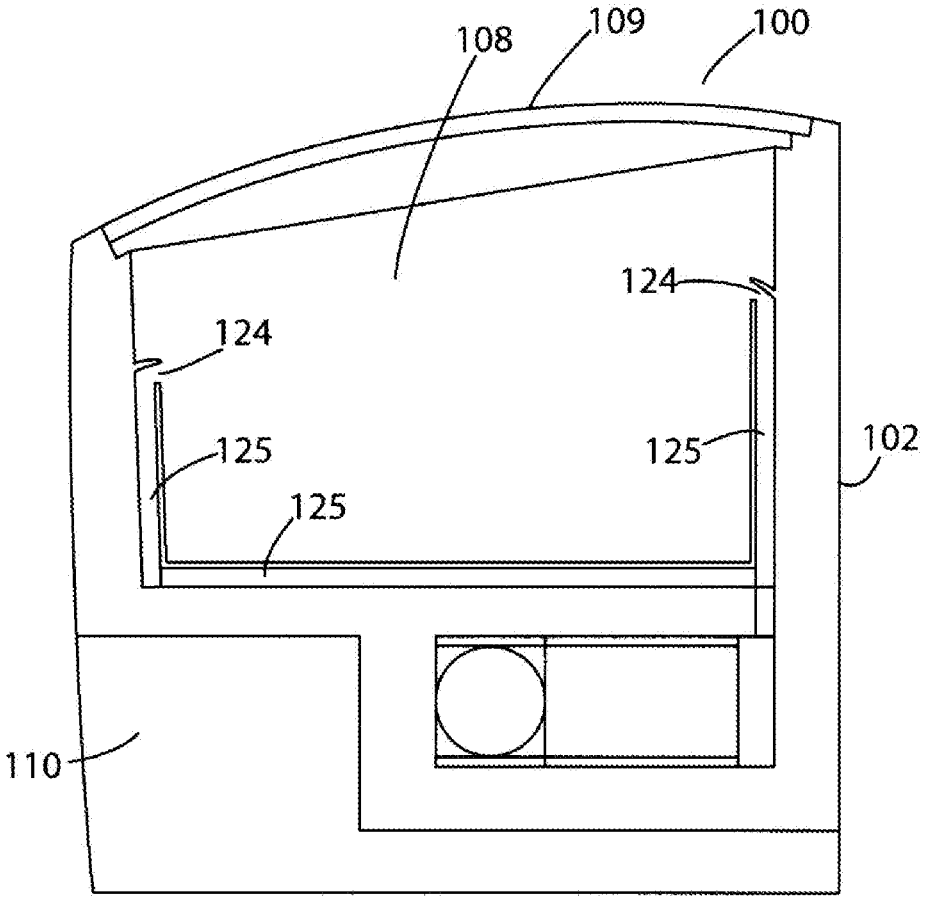
FIG. 17 is a side sectional elevational view taken along the line XVII-XVII in FIG. 15.
Figure 18:
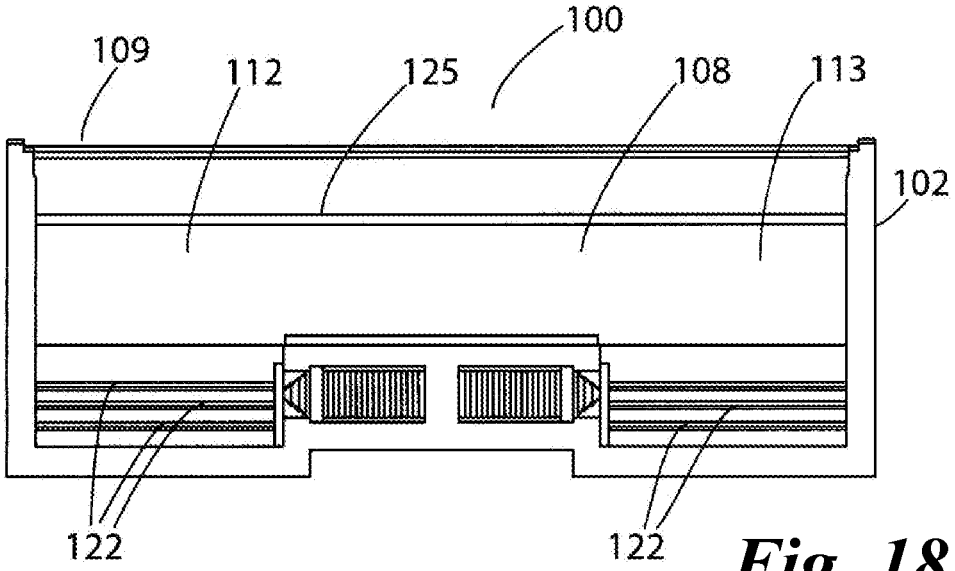
FIG. 18 is a sectional elevational view of the refrigeration cabinet of FIG. 15.
Figure 19:
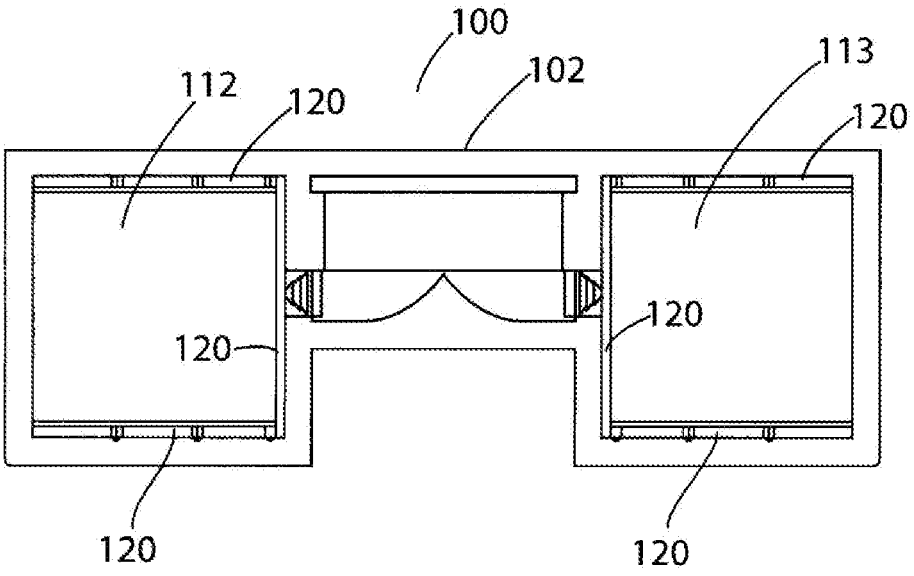
FIG. 19 is a sectional plan view of the refrigeration cabinet of FIG. 15.

Referring in particular to FIGS. 12 and 13, the refrigeration unit cassette 12 is shown in more detail. The evaporator and fan are mounted within a foam casing 86 having an air outlet 87 and a return air inlet 88. Each of the air outlet 87 and the air inlet 88 have formations 89, 90 for docking engagement with an inlet 67 of the air inlet duct 25 and an outlet end of the air outlet duct 27 formed between the liner 66 and the insert 68.

Figure 9:
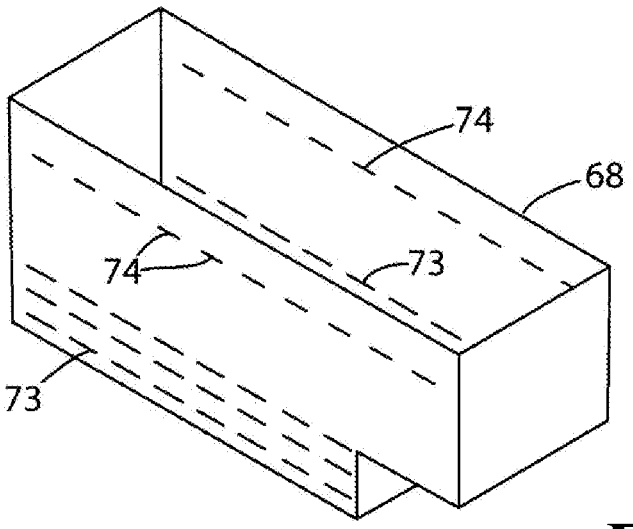
FIG. 9 is a detail perspective view of an air distribution insert of the refrigeration cabinet of FIG. 7.
Figure 14:
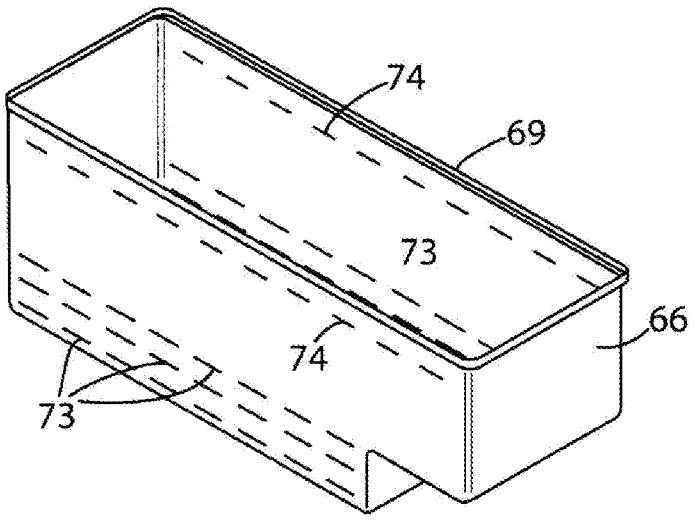
FIG. 14 is a view similar to FIG. 9 showing air distribution insert.

FIG. 14 shows an air distribution insert 66 which is essentially the same as the air distribution insert shown in FIG. 9, however, this is of moulded plastics construction and includes an integral sealing rim 69 extending about the top of the insert 66.

Referring now to FIGS. 15 to 19, there is shown another refrigeration cabinet according to a fourth embodiment of the invention indicated generally by the reference numeral 100. The refrigeration cabinet 100 has an insulated body 102 comprising a base 103 with an upstanding front wall 104, rear wall 105 and end walls 106, 107 interconnecting the front wall 103 and rear wall 104. The body 102 forms an open-topped product chamber 108. A clear glass lid 109 is mounted on top of the body 102 to close the product chamber 108, whilst at the same time allowing customers to view chilled or frozen merchandise on display within the product chamber 108. In this case, the refrigeration cassette 12 engages within a central slot 110 in the body 102. A casing 111 defining the slot 110 divides the product chamber 8 into separate wells 112, 113 at either side of the casing 111. Air delivery ducts 120 at a bottom of each well 112, 113 deliver cooled air into each well 112, 113 through louvered air inlets 122. A return air duct 125 is formed along inside faces of the front wall and rear wall of the product chamber 108 for return of air from a top of the product chamber 108 through air outlets 124 to the evaporator for further cooling.

The invention is not limited to the embodiments hereinbefore described which may be varied in both construction and detail within the scope of the appended claims.

What is claimed is:

1. A refrigeration cabinet for storage and display of frozen products for sale, the refrigeration cabinet including:

an insulated cabinet body forming an open-topped product chamber closed by a clear lid at a top of the product chamber;

the clear lid being movable on the insulated cabinet body between a closed position closing the product chamber and an open position on the insulated cabinet body to allow access to the product chamber from above the product chamber;

a refrigeration unit for generating a climate control cold air stream, the refrigeration unit including an evaporator and an associated fan for generating the climate control cold air stream;

an air circulation duct for delivering the climate control cold air stream through the product chamber, the air circulation duct having an air inlet communicating with a lower portion of the product chamber and an air outlet communicating with the product chamber above the air inlet, the air circulation duct including an air inlet duct formed in a side wall of the product chamber at the lower portion of the product chamber for delivery of the climate control cold air stream into the product chamber and an air outlet duct formed in the side wall of the product chamber at an upper portion of the product chamber for delivery of the climate control cold air stream out of the product chamber, the air inlet duct having an air inlet opening communicating with the product chamber and the air outlet duct having an air outlet opening communicating with the product chamber, each air duct being connected to the refrigeration unit for circulating the climate control cold airstream through the product chamber, the air inlet duct communicating with the evaporator and the associated fan is being configured to deliver air across the evaporator and into the air inlet duct for delivery into the product chamber, and the air outlet duct communicating with the evaporator to deliver air from the product chamber to the evaporator, the air circulation duct including an air distribution insert mounted in the product chamber, an exterior of the air distribution insert cooperating with an inner wall of the product chamber to define the air ducts;

sealing elements extending between an exterior of a front panel and a rear panel of the air distribution insert and inner side walls of the cabinet body;

the sealing elements dividing a space between the exterior of the air distribution insert and the inner wall of the product chamber into a lower air inlet duct below the sealing elements and an upper air outlet duct above the sealing elements;

a number of spaced-apart air inlet openings in the front panel and the rear panel of the air distribution insert below the sealing elements; and a plurality of spaced-apart air outlet openings in the front panel and the rear panel of the air distribution insert above the sealing elements between the sealing elements and a rim at a top of the air distribution insert;

the air circulation duct and the refrigeration unit being operable to feed cooling air through the product chamber to avoid air turbulence at the clear lid, wherein cold air is delivered into a bottom of the product chamber and gradually displaced upwardly through the product chamber and drawn out at the top of the product chamber such that a layer of warmer air tends to form immediately below the clear lid, above the air outlet, to avoid condensation and frosting on an underside of the clear lid.

2. The refrigeration cabinet as claimed in claim 1, wherein the air circulation duct includes an air distribution insert mounted in the product chamber, an exterior of the air distribution insert cooperating with the inner wall of the product chamber to define the air ducts, the air distribution insert having openings for through passage of air between the ducts and the product chamber.

3. The refrigeration cabinet as claimed in claim 2, wherein the air distribution insert is demountably secured in the product chamber.

4. The refrigeration cabinet as claimed in claim 2, wherein the cabinet comprises an outer casing, a liner forming the product chamber mounted within the outer casing and spaced-apart therefrom, insulation material mounted between the outer casing and the liner, the air distribution insert being mounted within the liner and cooperating with the liner to form the air inlet duct and the air outlet duct.

5. The refrigeration cabinet as claimed in claim 4, wherein each sealing element is mounted between the liner and the air distribution insert between the air inlet openings at a bottom of the air distribution insert and the air outlet openings at a top of the air distribution insert isolating the air inlet openings from the air outlet openings to define the air inlet duct and the air outlet duct between the liner and the air distribution insert.

6. The refrigeration cabinet as claimed in claim 5, wherein the sealing element is mounted on the liner.

7. The refrigeration cabinet as claimed in claim 5, wherein the sealing element is mounted on the air distribution insert.

8. The refrigeration cabinet as claimed in claim 4, wherein the liner has a base with upstanding side walls, a number of air deflectors are mounted spaced-apart on the base and project upwardly therefrom, the air distribution insert seating on the air deflectors, the air deflectors for controlling distribution of cooling air to the air inlet duct openings of the air distribution insert communicating with the product chamber.

9. The refrigeration cabinet as claimed in claim 1, wherein the refrigeration unit further includes a refrigerant circulating system having a compressor, a condenser, and a throttle.

10. The refrigeration cabinet as claimed in claim 9, wherein the refrigeration unit is mounted on a cassette which is demountably engagable with the cabinet body.

11. The refrigeration cabinet as claimed in claim 10, wherein the evaporator and the fan are mounted within a foam casing having an air outlet and a return air inlet, the air outlet and the return air inlet having docking formations for complementary docking engagement with an inlet end of the air inlet duct and with an outlet end of the air outlet duct.

* * * * *